US005203047A

United States Patent [19]

Lynn

[11] Patent Number: 5,203,047

[45] Date of Patent: Apr. 20, 1993

[54] CLEANING APPARATUS WITH ROTATABLE ENDLESS BELT

[76] Inventor: William R. Lynn, 38 Prospect St., Dover, N.H. 03820

[21] Appl. No.: 730,641

[22] Filed: Jul. 16, 1991

[51] Int. Cl.[5] ..... A47L 11/282; A47L 11/292

[52] U.S. Cl. ..... 15/99; 15/51; 15/98

[58] Field of Search ..... 15/99, 97.1, 51, 52, 15/321, 322, 98

[56] References Cited

U.S. PATENT DOCUMENTS

| | | | |
|---|---|---|---|
| 2,142,605 | 1/1939 | Dawson et al. | 15/99 |
| 2,257,391 | 9/1941 | McDonell | 15/99 |
| 2,642,602 | 6/1953 | Saffioti | 15/98 |
| 2,857,606 | 10/1958 | Sperka | 15/98 |
| 3,090,982 | 5/1963 | Skinas | 15/99 |
| 3,945,078 | 3/1976 | Acquaro | 15/99 |
| 4,570,278 | 2/1986 | Bloome et al. | 15/98 |

*Primary Examiner*—Edward L. Roberts

*Attorney, Agent, or Firm*—Davis, Bujold & Streck

[57] ABSTRACT

An improved cleaning apparatus system used for cleaning a surface comprising in combination a surface cleaning head having a frame supporting a rotatable belt for absorbing liquid and contaminants from a surface to be cleaned, a mechanism for conveying the rotatable belt and removing liquid and contaminants therefrom which have been absorbed from the surface to be cleaned and a storage device for storing the liquid and contaminants removed from the rotatable endless belt, a handle member connected to the surface cleaning head whereby the handle member can be used to facilitate operation of the surface cleaning head, wherein the rotatable endless belt is rotatable in a direction substantially transverse to a longitudinal operational direction of the apparatus defined by the handle member and a vacuum source can be provided for assisting with removal of the absorbed liquid and contaminants and conveying them to a storage device.

6 Claims, 7 Drawing Sheets

CLEANING APPARATUS WITH ROTATABLE ENDLESS BELT

This invention relates to improvements concerning a cleaning device and, more particularly, an endless belt cleaning device which is able to remove fluids and other contaminants from a surface to be cleaned, such as a floor, wall or ceiling, and convey the same into a storage reservoir or container.

BACKGROUND OF THE INVENTION

There are a number of cleaning systems presently in use for cleaning a surface. However, none of the known systems allow an endless belt to be conveyed or driven in a direction transverse to the normal cleaning direction of the device, to result in improved cleaning of that surface, or allows suction of the removed liquids and contaminants into an appropriate storage container.

Wherefore, it is an object of the present invention to provide a cleaning apparatus in which the cleaning solution, stored in supply container, and the collected solution and contaminants removed from a surface being cleaned, collected in a reservoir or cavity, are stored separately from one another and, in one embodiment, a vacuum is applied to the reservoir or cavity to remove the collected solution and contaminants removed from a surface and convey them to a storage device.

Another object of the invention is to provide a cleaning apparatus which makes efficient use of a cleaning solution and removes most of the cleaning solution from the surface being clean so as to leave that surface relatively dry immediately after completion of the cleaning process.

A further object of the invention is to provide cleaning apparatus which can be driven intermittently or continuously to provide better abrasive/cleaning action against the surface being cleaned to obtain a cleaner surface with less motion and physical effort.

A still further object of the present invention is to provide, in one embodiment, a cleaning apparatus which is capable of dual direction scrubbing of the surface being cleaned.

These and other objects of the invention will be better understood by those skilled in the art by having reference to the attached drawings and the following description.

SUMMARY OF THE PRESENT INVENTION

The present invention relates to an improved cleaning apparatus system used for cleaning a surface comprising in combination a surface cleaning head having a frame supporting rotatable means for absorbing liquid .and contaminants from a surface to be cleaned, said rotatable absorbent means having a means for removing liquid and contaminants therefrom which has been absorbed from the surface to be cleaned and means, associated with said removing means, for storing the liquid and contaminants removed from said rotatable absorbent means; means for rotating said rotatable absorbent means; a handle member defining a longitudinal axis; and connection means for connecting one end of said handle member to said surface cleaning head whereby said handle member can be used to operate said surface cleaning head in a direction along said longitudinal axis; wherein said rotatable absorbent means is rotatable in a direction substantially transverse to the longitudinal operational direction defined by said handle member.

The present invention also relates to an improved surface cleaning apparatus used for cleaning a surface comprising in combination a surface cleaning head having a frame supporting rotatable means for absorbing liquid and contaminants from a surface to be cleaned, said rotatable absorbent means having means for removing liquid and contaminants therefrom, which has been absorbed from the surface to be cleaned, and conveying the liquid and contaminants removed from said rotatable absorbent means to a storage device; means for rotating said rotatable absorbent means; a handle member defining a longitudinal axis; and connection means for connecting one end of said handle member to said cleaning head whereby said handle member can be used to operate said surface cleaning head in a direction along said longitudinal axis; wherein said means for removing and conveying comprise vacuum means for sucking the liquid and contaminants from said rotatable endless belt and conduit means for conveying the sucked liquid and contaminants from said endless belt to said storage device located remote from said cleaning head.

BRIEF DESCRIPTION OF THE DRAWINGS

The present invention will now be described, by way of example, with reference to the accompanying drawings in which.

DESCRIPTION OF THE PREFERRED EMBODIMENT

Figure 1:
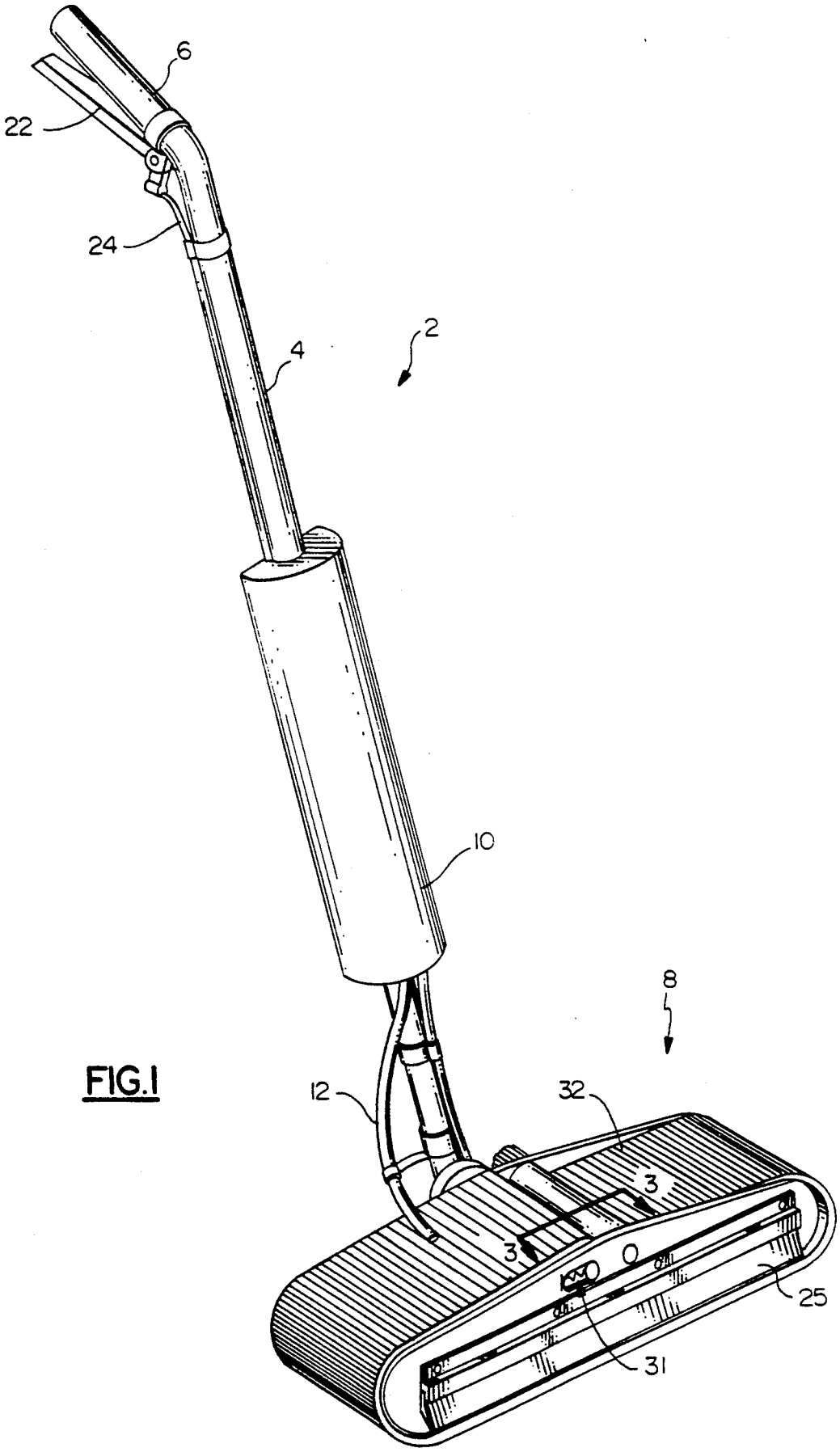
FIG. 1 is a diagrammatic perspective view of a first embodiment of the present invention.
Figure 3:
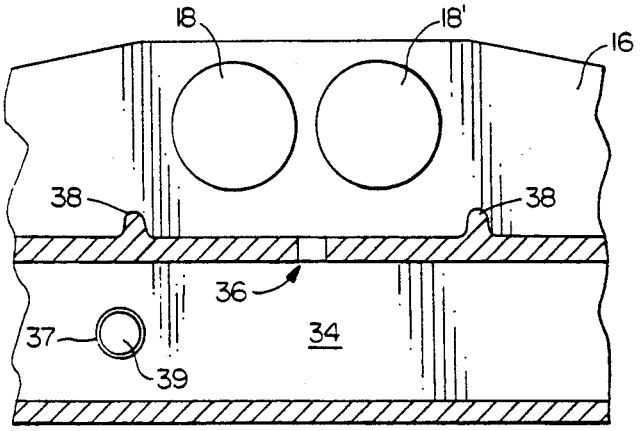
FIG. 3 is a partial cross-sectional view of the cleaning head of the first embodiment along section line 3—3 of FIG. 1.
Figure 2:
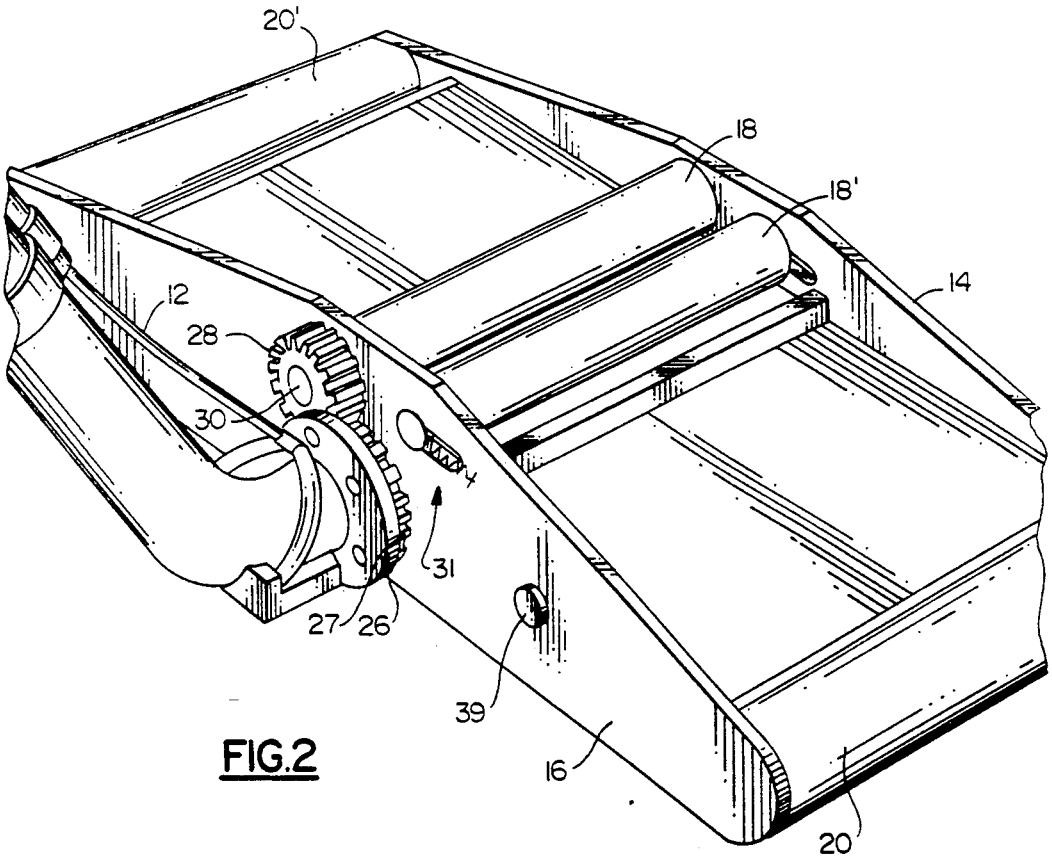
FIG. 2 is a partial diagrammatic perspective view of the apparatus of FIG. 1 in which the endless belt has been removed for clarification purposes.

With reference now to FIGS. 1–3, the cleaning apparatus 2 of the present invention will now be described in detail. The cleaning apparatus 2 comprises an elongate handle member or shaft 4 having a handle means 6 at one end thereof and a cleaning head 8 connected, via any suitable well known means, to the opposite end thereof. A cleaning solution storage container 10, containing a cleaning solution, is attached to a central portion of the shaft 4. A first end of a supply tube 12 is connected to a lower portion of the solution storage container 10 while the opposite end of the tube is located adjacent the cleaning head 8 and positioned for depositing the cleaning solution onto a rotatable endless belt 32. A suitable nozzle or spray mechanism may be attached to the opposite end of the supply tube (not shown). A conventional cleaning solution feed mechanism (not shown) is used to dispense the cleaning solution, as desired, onto the endless belt. As such spray and dispensing mechanisms are well known in the art, they not discussed herein in any further detail.

The cleaning head 8 comprises a pair of spaced apart front and rear frame or support members 14, 16, respectively, extending parallel to one another. A pair of pinch rollers 18, 18,, extending perpendicularly to the front and rear support members 14, 16, are supported adjacent an upper central portion of those two support members. A first return roller 20 extends perpendicularly between the front and rear support members 14, 16, adjacent one end thereof, while a second return roller 20' extends perpendicularly between the two support members adjacent the opposite end thereof (see FIG. 2).

A lever 22, or other actuation mechanism, is attached to the handle means 6. One end of a flexible cable 24 is connected to the lever 22 while the opposite end of the flexible cable 24 is connected to drive a drive gear 27 via a free wheel mechanism 26 (see FIG. 2), located adjacent the opposite end of the shaft which drives gear 27 in a drive direction and is able to free wheel in a return direction. When the lever 22 is operated, it drives the drive mechanism 26 which in turns drives gear 27, a gear 28 connected to a shaft 30 supporting the pinch roller 18 and, in turn, the endless belt 32 supported thereon intermittently, as desired. The end portions of one of the pinch rollers 18' are spring biased (see FIG. 2) toward the other pinch roller 18 by a spring mechanism 31 to produce the necessary friction for driving the endless belt 32 and squeezing the removed liquid and contaminants from the endless belt 32.

A reservoir 34, for collecting the fluids and/or contaminants removed from the surface being cleaned, is provided in an interior space located between the front and rear support members 14, 16 and the return rollers 20, 20'. A drainage aperture 36 (see FIG. 3) is provided adjacent the pair of pinch rollers 18, 18' to allow any fluid and/or other contaminants squeezed from the endless belt 32, as it is conveyed between the pair of pinch rollers 18, 18', to flow via gravity through the drainage aperture 36 into the reservoir 34 where it is temporarily stored. A pair of protrusions or short wall members 38 extend between the front and rear support members 14, 16, parallel to the pinch rollers, to assist with channeling of fluid and/or other contaminants removed from the surface being cleaned into the reservoir 34. A drainage outlet 37 is provided in the rear support member 16 to allow removal of the fluid and/or other contaminants from the reservoir, as desired, once a plug 39 is removed from the drainage outlet 37.

A squeegee 25 can be provided, if desired, on the cleaning head 8 to ensure that the surface is relatively dry after a cleaning operation.

Figure 4:
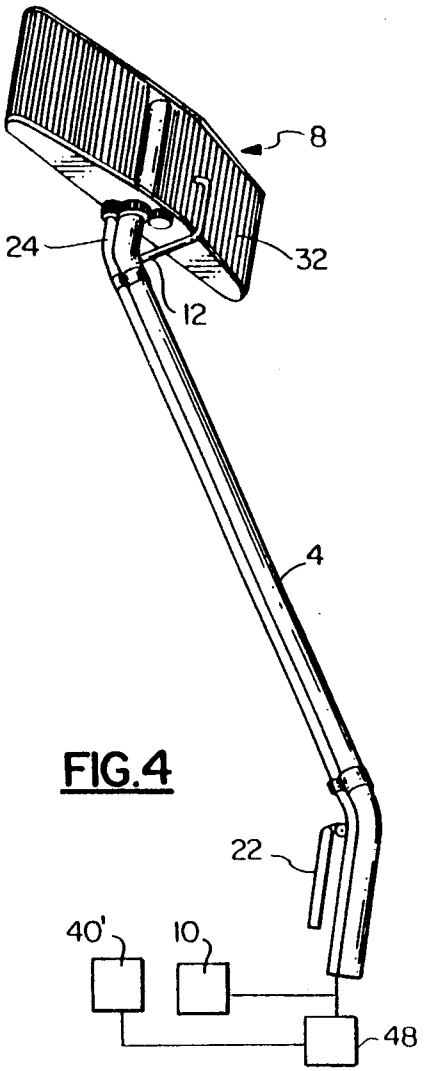
FIG. 4 is a partial diagrammatic perspective view of a second embodiment of the present invention.
Figure 5A:
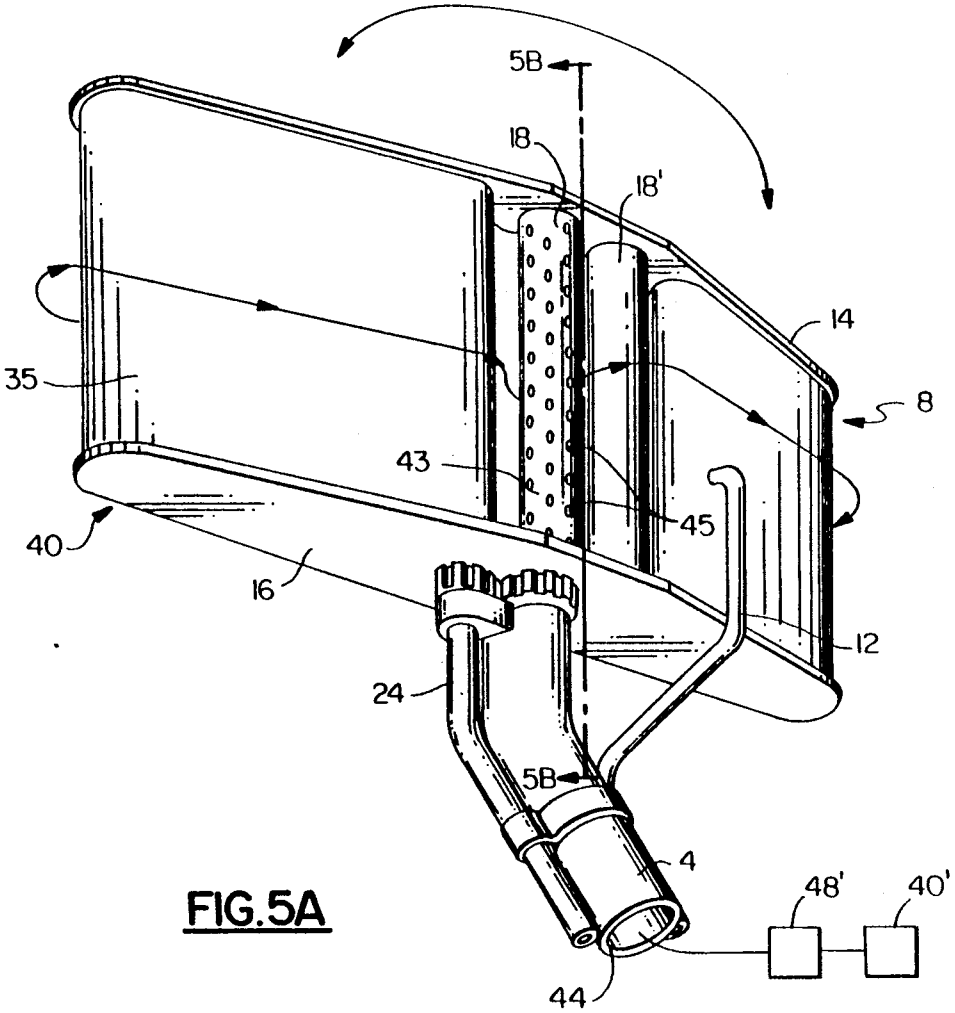
FIG. 5A is a partial enlarged diagrammatic view of the second embodiment cleaning head shown in FIG. 4.
Figure 5B:
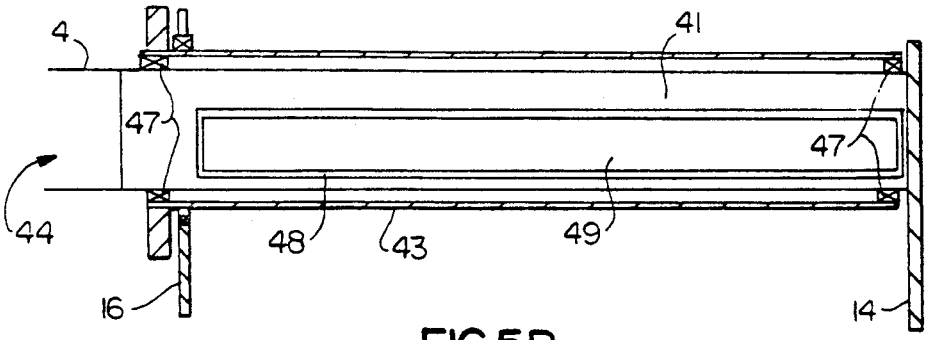
FIG. 5B is a partial diagrammatic cross sectional view of the second embodiment of the present invention along section line 5B—5B of FIG. 5A.

Turning now to FIGS. 4, 5A and 5B, the second embodiment of the present invention will now be discussed in detail. This embodiment operates similarly to that of the first embodiment but is structurally somewhat different. The major differences between the first and second embodiments are that the drainage aperture 36 has been replaced by suction means 40' which communicates with pinch roller 18. That pinch roller 18 comprises a fixedly positioned internal tube 41 having an elongate slot or inlet 49, with an arc width extending from about 25 to 90 degrees or so, facing the other pinch roller 18'. A perforated exterior shell 43, having a plurality of holes 45 therein, is supported by a pair of bearings 47, located at opposed ends of the perforated shell 43, which in turn are supported by the internal tube 41. The perforated shell surrounds the internal tube 41 and is provided to allow rotation of the endless belt (not shown) relative to the internal tube 41. A perimeter seal 48, located adjacent the slot opening, is located between the exterior surface of the internal tube and the interior surface of the perforated exterior shell 43 to assist with obtaining maximum negative pressure during suction.

In this embodiment, the return rollers have been eliminated in favor of a contoured exterior surface 35 of the cleaning head 8 which promotes conveyance of the endless belt (not shown) around the cleaning head 8. A suction tube or conduit 44 is formed integrally with the hollow elongate shaft 4 and a first end of the suction tube is connected with one end of the internal tube 41, the other end of the internal tube 41 being sealed, while a second end of the suction tube or conduit 44 is connected a collection and storage container 48 which in turn is connected to appropriate vacuum means 40'. The main purpose of the pinch rollers is to convey the endless belt and to assist with removal of the fluid and other contaminants from the endless belt 32. As the endless belt is conveyed by the pinch rollers 18, 18', the liquid and other contaminants removed from the surface being cleaned are sucked, via vacuum and separation means 40', through the endless belt 32, the holes 45 in the perforated shell 43 and the inlet 49 of the internal tube 41 where they are conveyed by the suction tube or conduit 44 to the collection and storage container 48 where the liquid and solid components can be separated from the gaseous components. Alternatively, the suction tube or conduit 44 could be located adjacent and extend parallel to the shaft 4 being connected thereto.

As with the first embodiment, the end portions of one of the pinch rollers 18' are spring biased (see FIG. 2) toward the other pinch roller 18 by a spring mechanism (not shown) to produce the necessary friction for driving the endless belt 32 and removing the liquid and contaminants from the endless belt.

A supply tube 12 is provided for supplying a cleaning solution from a supply source 10 to the endless belt 32 so that the solution can be conveyed to the surface being cleaned and thereafter be removed once sufficient cleaning has occurred.

This embodiment is useful for cleaning a surface such as a wall or ceiling and may be used in combination with the suction equipment more particularly described in my co-pending patent application Ser. No. 07/639,880 filed on Jan. 11, 1991, U.S. Pat. No. 5,134,748. That teaching is incorporated herein by reference.

Figure 7:
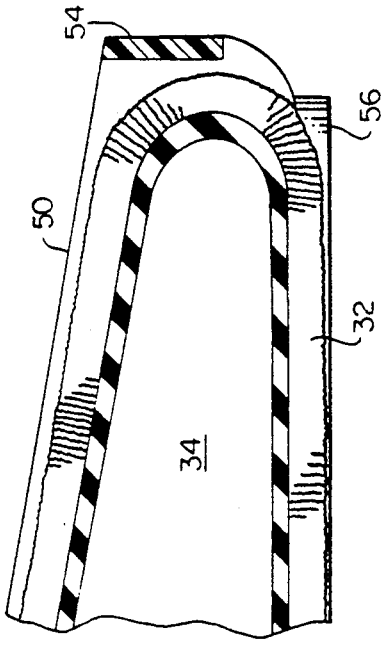
FIG. 7 is a partial cross-sectional view of the cleaning head of the third embodiment along section line 7—7 of FIG. 6.
Figure 6:
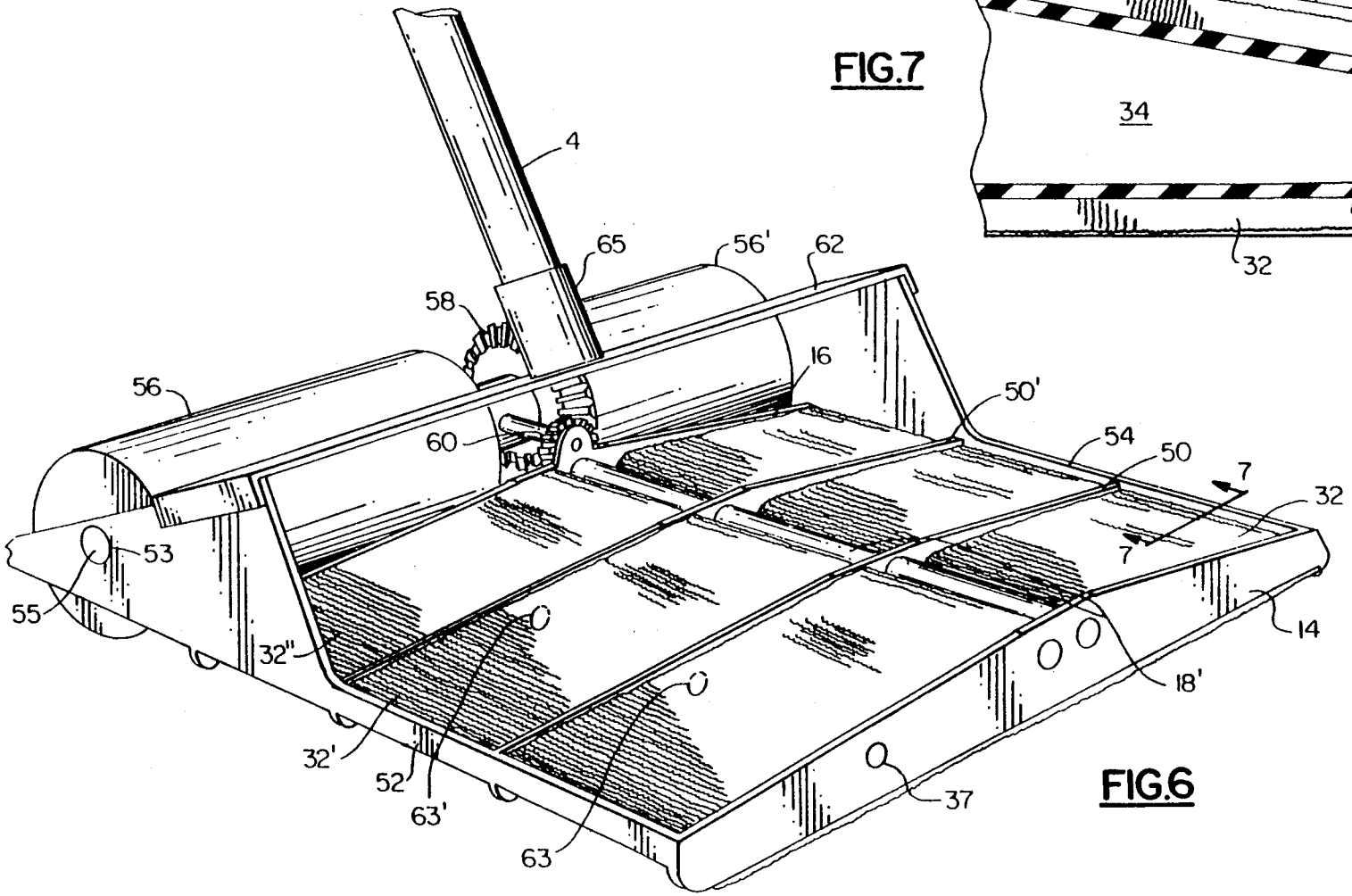
FIG. 6, is a partial diagrammatic perspective view of a third embodiment of the present invention; .

Turning now to FIGS. 6 and 7, a third embodiment of the present invention will now be described in detail. This embodiment is very similar to the first embodiment but comprises three independent, side by side rotatable endless belts 32, 32', 32'' which have been combined into a single cleaning unit. Located between and extending parallel to the front and rear support members 14, 16 are two intermediate frame or support members 50 and 50'. A pair of side frame or support members 52, 54 extend perpendicularly to all four of the support member 14, 16, 50, 50' and interconnecting the end portions to form a rigid rectangular base or frame. One end of each of the side support members 52, 54 is provided with an aperture 53 accommodating a shaft 55 supporting a pair of rotatable drive rollers 56, 56'. The aperture 53 supporting the shaft 55 of the drive rollers 56, 56' is located in the side support members 52, 54 so that the drive rollers are able to engage the surface being cleaned while still allowing each of the three endless belts 32, 32', 32" also to contact the surface being cleaned so that sufficient surface cleaning is achieved by the endless belts. One of the drive rollers 56' is provided with a drive gear 58 which meshes with an idler gear 60, supported by the rear support member 16. The idler gear, in turn, meshes with a gear 28 carried by the shaft 30, extending the entire length of the cleaning unit, to drive the pinch roller 18 which, in turn, drives simultaneously all three of the endless belts 32, 32', 32".

The shaft 4 is connected, via housing 65, to a cross member 62 which extends and is connected between the pair of side support members 52, 54. This arrangement provides a mechanism for controlling the movement of the cleaning apparatus along a longitudinal axis defined by the shaft. In this embodiment, all three reservoirs are connected with one another via apertures 63, 63' (shown in ghost) to allow drainage of the reservoirs through a single drainage outlet 37 once the drainage plug 39 is removed.

It is to appreciated that, by varying the gearing and/or drive mechanism, a variety of different drive arrangements are possible. For example, the endless belts 32 and 32" could be driven in a first direction by the gears 60 and 28 and the shaft 30 while the endless belt 32' could be driven directly by the idler gear 60, with appropriate gearing, in an opposite direction. In addition, the speed for driving the endless belts 32, 32', 32" could be varied by appropriate gearing and, as such gearing is well known in the art, it not discussed further in detail.

Figure 9:
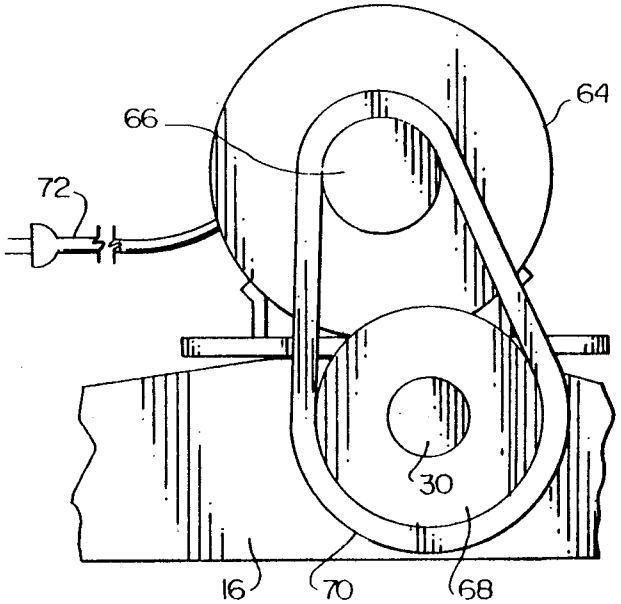
FIG. 9 is a partial diagrammatic front elevational view showing the drive mechanism for the fourth embodiment of FIG. 8.
Figure 8:
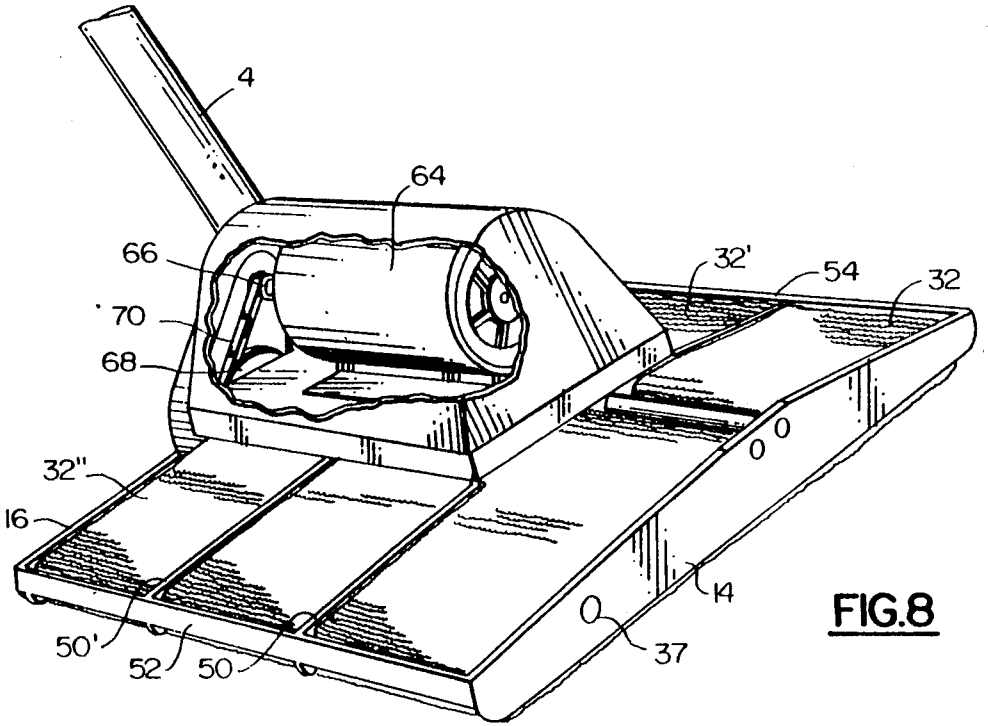
FIG. 8 is a partial diagrammatic perspective view of a fourth embodiment of the present invention.

Turning now to FIGS. 8 and 9, the fourth embodiment of the present invention will now be discussed. This embodiment operates very similarly to the third embodiment except that an automatic drive means 64, such as an electrical motor, drives a drive pulley 66 which, in turn drives a driven pulley 68 via a drive belt 70. Driven pulley 68 is connected to the shaft 30 which drives the pinch roller 18 and, in turn, the endless belts 32, 32', 32". Power is supplied to the drive means 64 via a power source 72 such as a battery or an electrical cord plugged into an electrical outlet of a wall. An outer casing member 74 protects the motor and the associated components from cleaning fluids and other materials which could hinder operation of the drive mechanism.

Figure 11:
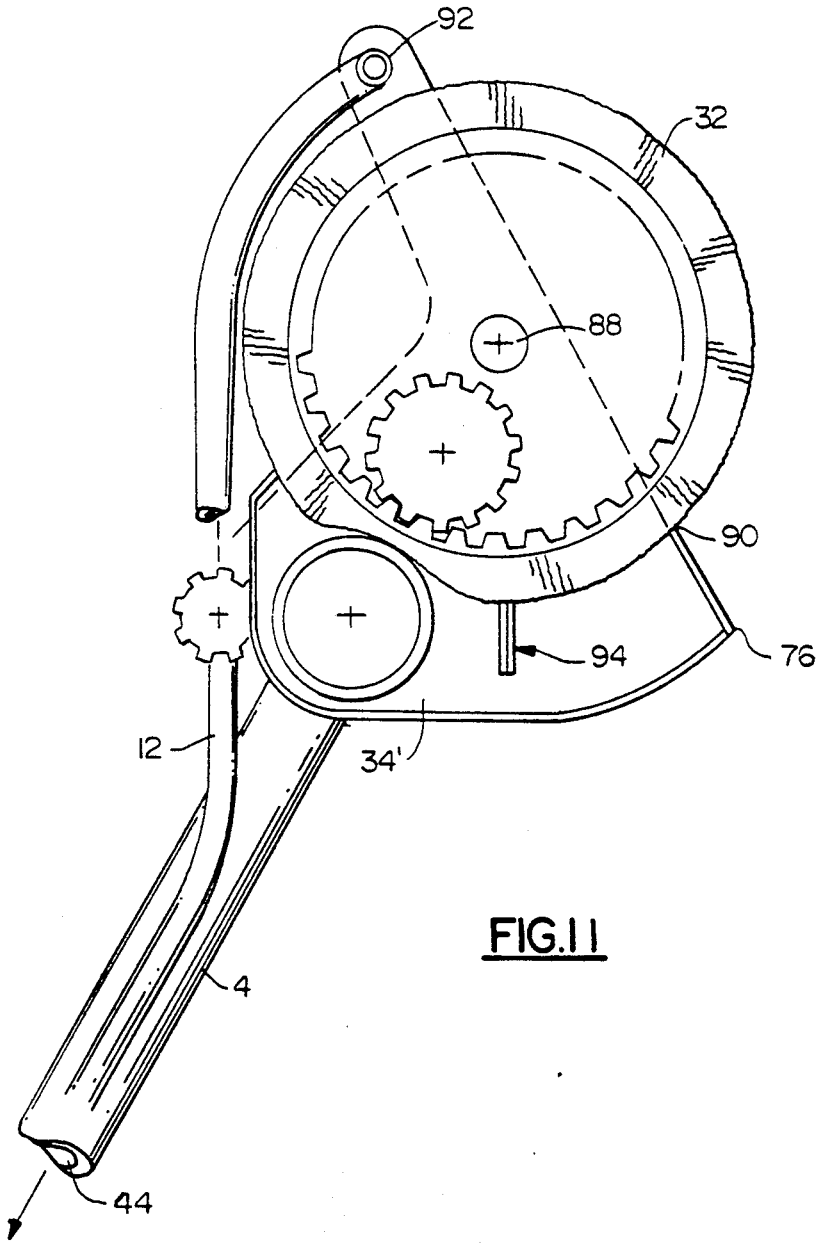
FIG. 11 is a partial diagrammatic end view of the fifth embodiment of FIG. 10.
Figure 10:
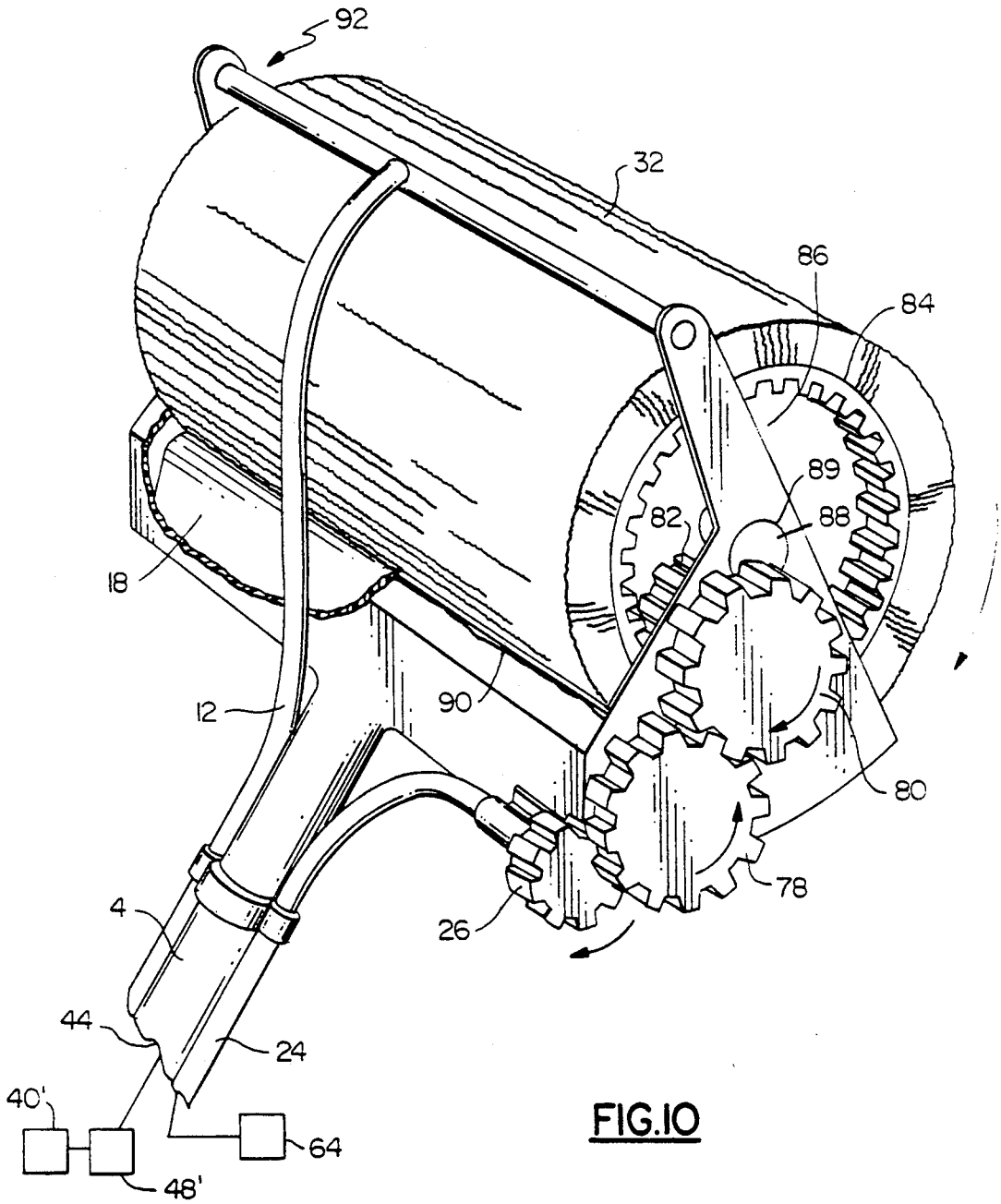
FIG. 10 is a partial diagrammatic perspective view of a fifth embodiment of the invention.

Turning now to FIGS. 10 and 11, the fifth embodiment of the present invention will now be discussed in detail. This embodiment is somewhat similar to the second embodiment discussed with respect to FIGS. 4, 5A and 5B in that the used cleaning fluid and the contaminants are removed via the suction tube or conduit 44, formed by the hollow shaft 4, by way of the vacuum and separation means 48, 40'. Suction tube or conduit 44 communicates with a reservoir or cavity 34' formed by an exterior casing 76 which surrounds and closely contacts a portion of the rotatable endless belt 32. A drive arrangement, for conveying the endless belt 32, is provided via a flexible cable 24 driven by motor 64 and driving gear 27 which, in turn, drives gears 78, 80 and 82 and finally a ring gear 84 connected to a roller 86 carrying the endless belt 32. The roller 86 is supported by a shaft 88 which is located in an aperture 89 provided in the exterior casing 76. It is to be appreciated that the perimeter of the exterior casing 76 should closely engage the roller 86 and the exterior surface of the endless belt 32 to maximize the suction effect achieved by the vacuum and separation means 48, 40'. If desired, the housing can be provided with a perimeter seal 90 to maximize the negative pressure achieved within the reservoir or cavity 34'. A cleaning brush 94 can be located within the reservoir and adjustably attach to an internal side portion of the exterior casing 76 to brush the surface of the endless belt 32 to assist with removal of debris and other contaminants therefrom. A freely rotatable pinch roller 18, housed within the exterior casing 76, is biased into engagement with the endless belt 32 by biasing means (not shown) to squeeze liquid therefrom.

A cleaning solution distribution system 92 can be attached to a supply tube 12 for distributing the cleaning solution equally across the width of the endless belt. As this embodiment may be use overhead for cleaning walls or ceilings, a pump may be provided for pumping the cleaning fluid through the supply tube. Such distribution means are well known in the art and are not discussed further in detail.

Although the present invention has been described in conjunction with five preferred embodiments, it is to be understood that variations and modifications may be resorted to without departing from the spirit or scope of the invention herein, as those skilled in the art will readily understand. Moreover, such modifications and variations are considered to be within the purview and scope of the invention herein involved and the appended claims.

I claim:

1. An improved cleaning apparatus for cleaning a surface, comprising in combination:

a surface cleaning had having a frame supporting a plurality of rotatable means for one of applying liquid to a surface to be cleaned and absorbing liquid and contaminants form the surface to be cleaned, said plurality of continuous rotatable absorbent means each having means for removing liquid and contaminants therefrom which has been absorbed form the surface to be cleaned, and means, associated with said removing means, for storing the liquid and contaminants removed form said plurality of continuous rotatable absorbent means;

means for rotating said plurality of continuous rotatable absorbent means;

a handle member defining a longitudinal axis; and connection means for connecting one end of said handle member to said surface cleaning head whereby said handle member can be used to operate said surface cleaning head in a direction along said longitudinal axis;

wherein said plurality of continuous rotatable absorbent means are rotatable in directions substantially transverse to the longitudinal operational direction defined by said handle member with at least one rotatable absorbent means rotating in a first direction and at least a second rotatable absorbent means rotating in a second opposite direction.

2. The improved cleaning apparatus according to claim 1, wherein each said plurality of continuous rotatable absorbent means is an absorbent endless belts.

3. The improved cleaning apparatus according to claim 2, wherein each said removing means is a pressure device for applying pressure to the associated said absorbent endless belt and squeezing liquid therefrom.

4. An improved cleaning apparatus according to claim 1, wherein container means, for containing a dispensable liquid, is attached to said handle member and arranged to supply the dispensable liquid onto at least one of said plurality of continuous rotatable absorbent means.

5. An improved cleaning apparatus according to claim 1, wherein said plurality of continuous rotatable absorbent means comprises three independent, sequentially arranged, side by side, conveyable endless belts.

6. The improved cleaning apparatus according to claim 1, wherein said means for rotating said plurality of continuous rotatable absorbent means comprises motor means for continuous rotation of said rotating means.

* * * * *